US006349445B1

(12) United States Patent
Mackay et al.

(10) Patent No.: US 6,349,445 B1
(45) Date of Patent: Feb. 26, 2002

(54) SUSPENDABLE TOOTHBRUSH

(76) Inventors: Spencer L. Mackay; Scott E. Winslow, both of 4940 Vineland Ave., North Hollywood, CA (US) 91601

( * ) Notice: Subject to any disclaimer, the term of this patent is extended or adjusted under 35 U.S.C. 154(b) by 0 days.

(21) Appl. No.: 09/500,975

(22) Filed: Feb. 15, 2000

(51) Int. Cl.[7] ..... A46B 9/04; A46B 15/00

(52) U.S. Cl. ..... 15/167.1; 15/143.1; 248/205.5; 248/683; 248/110; D4/108

(58) Field of Search ..... 15/143.1, 167.1, 15/246; 248/110, 205.5, 205.7, 206.2, 363, 683; 401/131; D4/108, 113

(56) References Cited

U.S. PATENT DOCUMENTS 963,264 A * 7/1910 Austin ..... 248/205.5
1,899,242 A 2/1933 McNab ..... 248/110
D215,738 S 10/1969 Allen ..... D6/534
4,453,285 A 6/1984 Van Rosberg ..... 15/164
5,742,971 A 4/1998 Salinger ..... 15/167.1
6,076,223 A * 6/2000 Dair et al. ..... 15/167.1

FOREIGN PATENT DOCUMENTS

CH 183428 * 12/1936 ..... 15/143.1
FR 774430 * 9/1934 ..... 15/246

* cited by examiner

*Primary Examiner*—Mark Spisich
(74) *Attorney, Agent, or Firm*—Jack C. Munro

(57) ABSTRACT

A toothbrush which has a brush head to which is mounted an elongated handle. At the free end of the handle is mounted a suction cup mounting device. The handle is integrally attached to the suction cup at the peripheral edge of the suction cup so that when the toothbrush is removed from a vertical surface on which it is attached by merely canting of the handle will result in breaking of the seal of the suction cup facilitating its disengagement.

3 Claims, 1 Drawing Sheet

SUSPENDABLE TOOTHBRUSH

BACKGROUND OF THE INVENTION

1) Field of the Invention

The field of this invention relates to toothbrushes and more particularly to a mounting device for mounting of the toothbrush in a suspended position on a vertical surface locating the toothbrush in a readily accessible position for reusage.

2) Description of the Prior Art

Toothbrushes are an exceedingly common usage by almost every individual within the United States. Toothbrushes comprise a brush head to which is attached an elongated handle. During the time that the toothbrush is not being used, it is stored with typical storing of the brush being within a medicine cabinet or within a cup that is located on a bathroom sink counter. Placing of a toothbrush within a medicine cabinet is not exactly a tidy storage situation nor is it sanitary. Placing the toothbrush within a cup again has the disadvantage of not being particularly sanitary and it is certainly not attractive in appearance.

In the past, it has been known to mount a suction cup to be used as a hanging device for a toothbrush. The suction cup is to be applied to a vertical surface causing the toothbrush to be suspended therefrom. In the past, the suction cup is centrally mounted to the end of the handle of the toothbrush. When it is desired to disengage the suction cup from the vertical surface, an outward pulling motion from the cup does not immediately result in disengagement of the suction cup from the vertical surface. The reason for this is that the outward pulling force is evenly distributed due to the central connection between the suction cup and the toothbrush handle. Additionally, the suction cup is molded separate from the toothbrush handle with there being utilized an attachment of some sort between the suction cup and the handle in order to connect such together. As a result, it is quite common for the suction cup to break free of the handle requiring replacement of the toothbrush and its suction cup attachment.

SUMMARY OF THE INVENTION

The suspendable toothbrush structure of the present invention relates to a mounting device in the form of a suction cup that is integrally mounted on the aft end of the handle of the toothbrush. The aft end of the toothbrush is mounted at the peripheral edge of the suction cup so that when the toothbrush is grasped from its suspended hung position attached to a vertical surface, only a minor deflection of the brush is required in order to break the suction seal of the suction cup facilitating the disengagement from the vertical surface.

One of the primary objectives of the present invention is to construct a suspendable toothbrush which facilitates the stowage of the toothbrush when it is not in use.

Another objective of the present invention is to construct a suspendable toothbrush which locates the toothbrush suspended in air which facilitates its drying during non-use thereby improving the sanitary condition of the toothbrush.

Another objective of the present invention is to construct a suspendable toothbrush that is constructed to make the disconnection of the toothbrush from its suspended storage position as easy as possible and making the disconnection a simple one-step operation.

Another objective of the present invention is to integrally connect the toothbrush handle and the suction cup thereby eliminating the possibility of disengagement and separation between the toothbrush handle and the suction cup.

DETAILED DESCRIPTION OF THE PREFERRED EMBODIMENT

Figure 1:
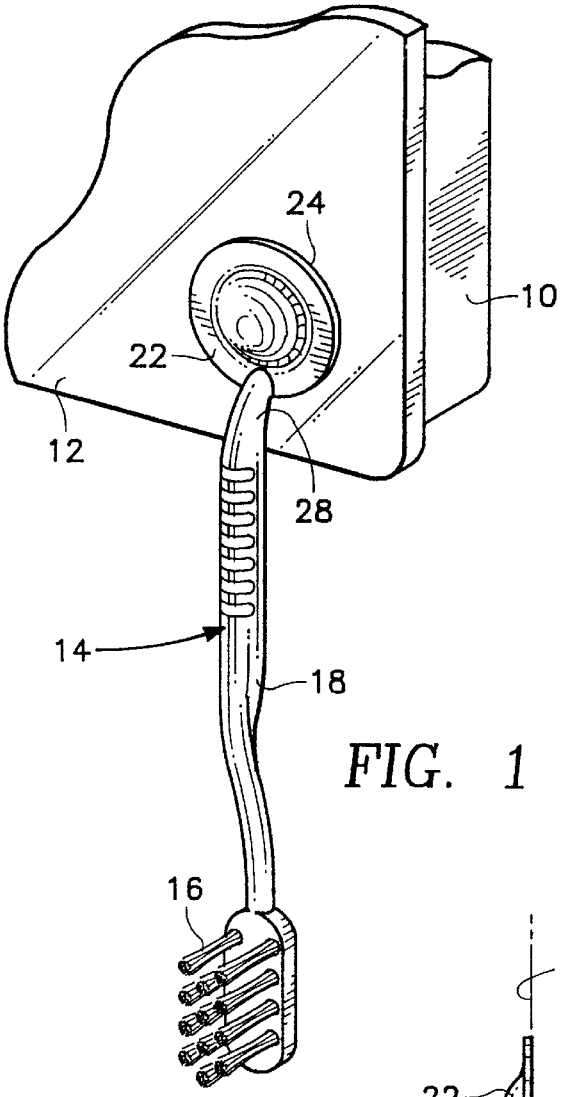
FIG. 1 is a an isometric view of a suspendable toothbrush of the present invention showing such attached on a typical vertical surface such as the front planer mirror of a medicine cabinet.
Figure 2:
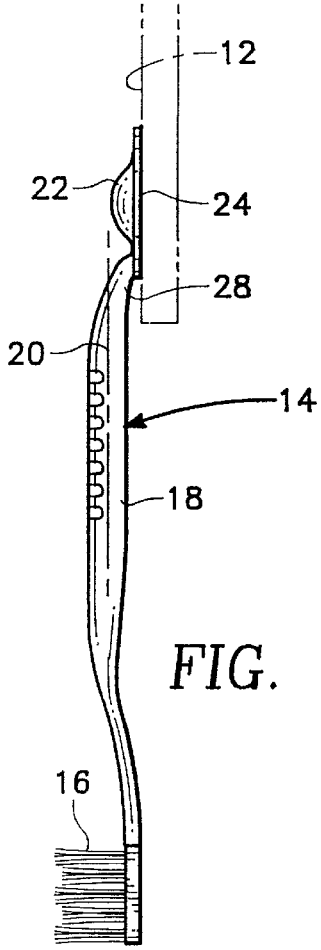
FIG. 2 is a side view of the toothbrush and mounting brush shown in FIG. 1.
Figure 3:
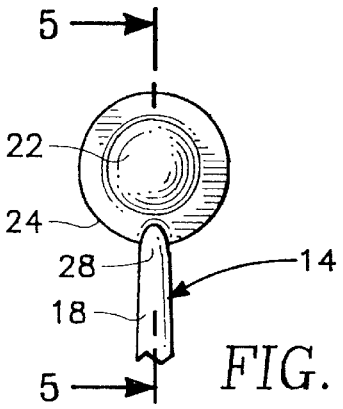
FIG. 3 is a front view of the mounting device and portion of the handle of the toothbrush.

Referring particularly to the drawings, there is shown a medicine cabinet base 10 to which is attached a door 12. The door 12 has an exterior planer surface which generally comprises a mirror or could comprise a tile surface. The toothbrush 14 of the present invention is capable of being mounted on any planer surface, the convenient planer surface being the exterior surface of the door 12.

The toothbrush 14 has a conventional brush head 16 composed of a mass of upstanding bristles which are mounted in a orientation generally normal to the handle axis. The brush head 16 is fixedly attached at the forward end of an elongated handle 18 which includes a rigid core 19. The elongated handle 18 has a longitudinal center axis 20. Mounted by being integrally molded at the aft end or free end of the elongated handle 18 is a suction cup 22. The suction cup 22 will normally be constructed of rubber or plastic resilient deflectable material. The suction cup 22 has a circular peripheral edge 24. Although the peripheral edge 24 is shown circular, it is considered to be within the scope of this invention that other configurations could be utilized. The suction cup 22 includes an internal cavity 26.

After usage of the toothbrush 14, the user is to merely place suction cup 22 directly adjacent a flat planer surface with the cavity 26 facing directly against this planer surface. By applying a small amount of manual pressure against the suction cup 22, the suction cup 22 will deflect decreasing the size of the cavity 26. Upon release of the manual force, there will be a natural tendency for the suction cup 22 to return to its non-deflected position. This will result in movement of the suction cup 22, slightly enlarging of the cavity 26 and producing of a partial vacuum therein. This partial vacuum will create a holding force that will suspendingly secure the toothbrush 14 in its suspended position. It is to be noted that the longitudinal center axis 20 will be located substantially parallel to the planer surface of the door 12. This will mean that the suspending force is located lateral relative to the suction cup 22 with this force not having any tendency to affect separation of the suction cup 22 from the vertical surface of the door 12.

Figure 4:
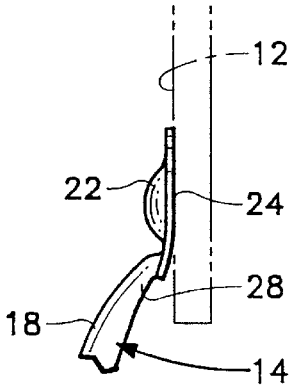
FIG. 4 is a view similar to FIG. 3 but showing the initial stage of disengagement of the toothbrush mounting device from the front surface of the medicine cabinet.
Figure 5:
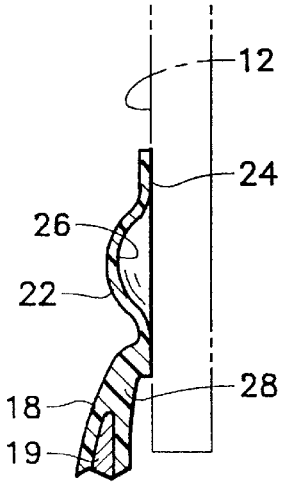
FIG. 5 is a cross-sectional view taken along line 5—5 of FIG. 3.

At the aft end of the handle 18 is located a bridge 28. The bridge 28 is integrally connected to the suction cup 22 at the peripheral edge 24. The reason for this is that when it comes to disengage the toothbrush 14 from the vertical surface of the door 12, the user only needs to grasp the handle 14 and move such to a an outwardly canted position, which is shown in FIG. 4. This will result in a portion of the peripheral edge 24 being lifted from the vertical surface of the door 12 which will break the seal created by the suction of the partial vacuum thereby facilitating the disengagement of the toothbrush 14 from the door 12 since there is now no holding force created by the suction cup 22 tending to maintain such secured to the vertical surface of the door 12. After separation of the toothbrush 14 from the door 12, the deflected position of the suction cup 22 is eliminated as the suction cup 22 quickly goes back to its original non-deflected position.

What is claimed is:

1. A suspendable toothbrush comprising:

an elongated handle with a brush head at a first end thereof and an opposite free second end;

a mounting device for hanging of said toothbrush in a suspended position on a vertical surface, said mounting device at the free second end of the handle, and comprising:

a suction cup, said suction cup to be applied onto the vertical surface producing a seal using a partial vacuum which adheres said suction cup to the vertical surface, said suction cup having a substantially flat peripheral edge bounding a concave interior cavity portion thereof, said elongated handle including a bridge portion integrally attached to and extending from the substantially flat peripheral edge and laterally spaced from the concave interior cavity portion, whereby when seeking removal of said toothbrush from said suspended position said elongated handle is to be grasped and deflected causing breaking of said seal permitting disengagement of said suction cup from the vertical surface.

2. The combination as defined in claim 1 wherein:

said peripheral edge being circular.

3. The combination as defined in claim 2 wherein:

said elongated handle having a longitudinal center axis, with said toothbrush in said suspended position said longitudinal center axis being located parallel to the vertical surface.

* * * * *